US006250000B1

(12) United States Patent
Diaz

(10) Patent No.: US 6,250,000 B1
(45) Date of Patent: Jun. 26, 2001

(54) ROTARY DRIVEN POSTER

(76) Inventor: Hugo Roberto Diaz, SAn Martin 686, 7° piso of., 72 - 1004 Capital Federal (AR)

( * ) Notice: Subject to any disclaimer, the term of this patent is extended or adjusted under 35 U.S.C. 154(b) by 0 days.

(21) Appl. No.: 09/108,374

(22) Filed: Jul. 1, 1998

(51) Int. Cl.[7] ..... G09F 11/02; G09F 15/00
(52) U.S. Cl. ..... 40/473; 40/607
(58) Field of Search ..... 40/473, 493, 607

(56) References Cited

U.S. PATENT DOCUMENTS 5,054,219 * 10/1991 Hoyt et al. ..... 40/473

* cited by examiner

*Primary Examiner*—Cassandra H. Davis
(74) *Attorney, Agent, or Firm*—Pendorf & Cutliff

(57) ABSTRACT

A rotary driven poster, for use in advertising, informative ends and other uses that include at least a main body with presenting faces that contain the advertising or informative composition of visual reception. The poster is mounted to a support with the body connected to a device that drives it with a uniform circular movement. The poster further includes a rotation center of the main body. The rotation center is connected to the support and possesses a radial arm on which a motor-reducer is mounted. The motor-reducer has an axis that supports a wheel. A ring-shaped piece is fixed to the structure of the main body and in concentric disposition with the rotation axis whose radius is equivalent to that of the radial arm. The ring-shaped piece has the support track of the wheel. The wheel is also the rotary driving means of the main body by way of the support track.

13 Claims, 7 Drawing Sheets

ROTARY DRIVEN POSTER

I BACKGROUND OF THE INVENTION

The present invention consists on a rotary driven poster, to be used with advertising, informative ends and other uses which allows a better visualization from vehicles and by pedestrians, during the day as well as night, and which suffers less damages than the conventional posters.

Up to the present day within the state of the art, different devices for signaling and advertising are known, among which the Argentine Patent No 247.035 must be mentioned. Basically it includes a means for visualization on the street provide with a space available for advertisement. It includes a column on which the signs are mounted by means of fixation clamps.

On the other hand, the present rotary driven poster includes a main body provided of rotary driving means and a space being defined in its interior which is apt for the placement of illumination means. This set can be easily disassembled from support, as much for the change of the messages on its faces as for maintenance and repair. Also, the structure of the main body and their frames are perfectly adaptable to different conformations, due to which said main body can be cubic, parallelepiped, pyramidal, conical, trunk-pyramidal, trunk-conical, spherical, etc.

Furthermore, as part of the previous art, a gyratory device included in the Argentine Patent N. 208.297, can be mentioned, which, although it possesses a gyratory main body, it is mainly a device adapted for its assembly in a hanging fixed column. This column, in one of its ends, is provided of a suspension baseboard and in the opposed end it has a solidary cover which contains an electric motor.

This motor has a speed reducer whose axis is projected to the exterior by the base of the coaxial cover to the referred column and it is linked to a central and internal base of a hollow gyratory structure.

With a different gyratory system, the poster of the present invention includes rotary driving means that consist, on one hand, in an articulate radial arm on which a motor-reducer is mounted in whose axis there is a friction wheel and, on the other hand, in a ring-shaped piece that conforms a support track for the mentioned friction wheel.

When putting into operation the motor-reducer, the friction wheel that supports on the rough support track of the ring-shaped piece, impels the rotary movement of the main body of the poster. This is so because the mentioned ring-shaped piece is fixed to the structure of the main body by means of the inferior frame.

In the system of the Argentine Patent N. 208.297 the action of any factor restraining the gyratory part, can lead to the deterioration of the reducer and the motor. It must be borne in mind that among these restraining factors there are the strong winds or the wearing out of the bearings on which it the mentioned gyratory part rotates.

On the other hand, the present invention does not have those drawbacks because any external or internal factor that restrains or stops the rotation of the main body, will have as sole effect the friction wheel to rotate slidingly on the support track. This is so because this wheel is simply leaning on the track under the influence of the weight of the radial arm and the motor-reducer.

Thus, the breaking of engagements, transmissions or other pieces, which, usually, integrate the mechanisms of rotating drive, is avoided. Also, in the case of damage, the radial arm possesses an articulation that allows to lift it until the repairs are made and thus avoiding the wearing out of the friction wheel.

Together with this, it is extremely beneficial that the main means of the present invention are inside the main body, since when disassembling easily this body from the end of its support, the maintenance tasks and repair can be carried out comfortably.

II BRIEF DESCRIPTION OF THE DRAWINGS

For better clarity and understanding of the object of the invention, it is illustrated with several figures which represent their preferred embodiments, everything as an illustrative example, not limitative:

Figure 1:
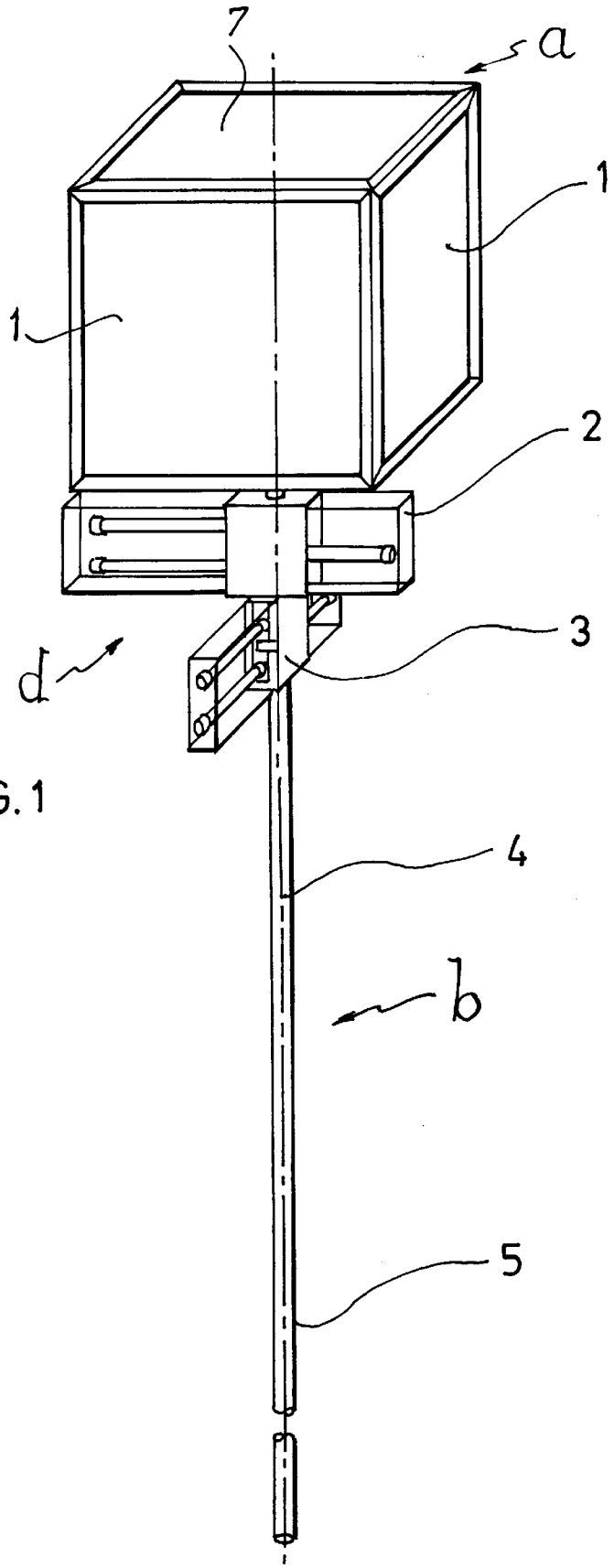
FIG. 1 is a view in perspective that allows to observe the general conformation of the present driven poster.
Figure 2:
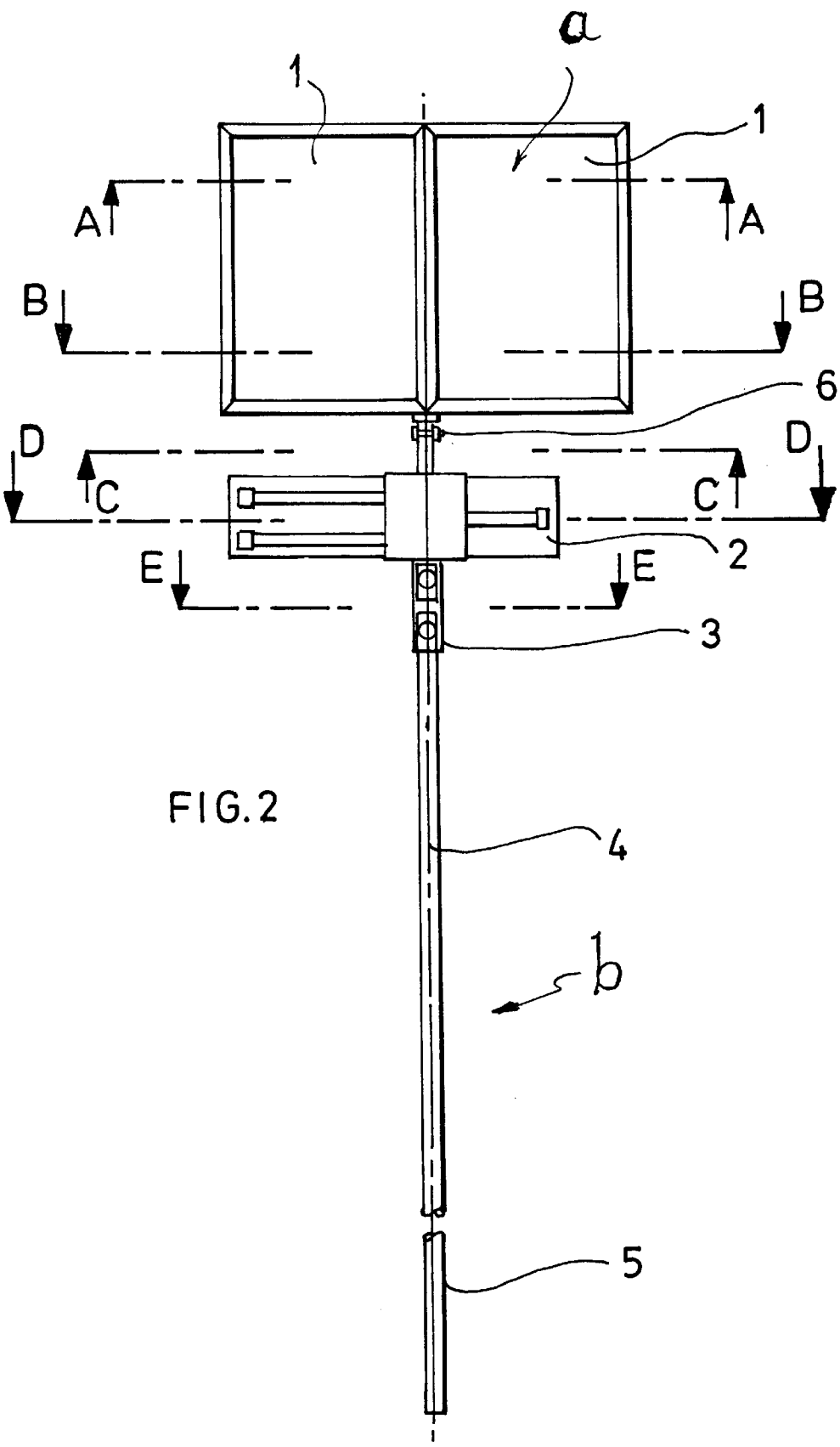
FIG. 2 is a lateral view in which connection between the main body and the support can be seen.
Figure 3:
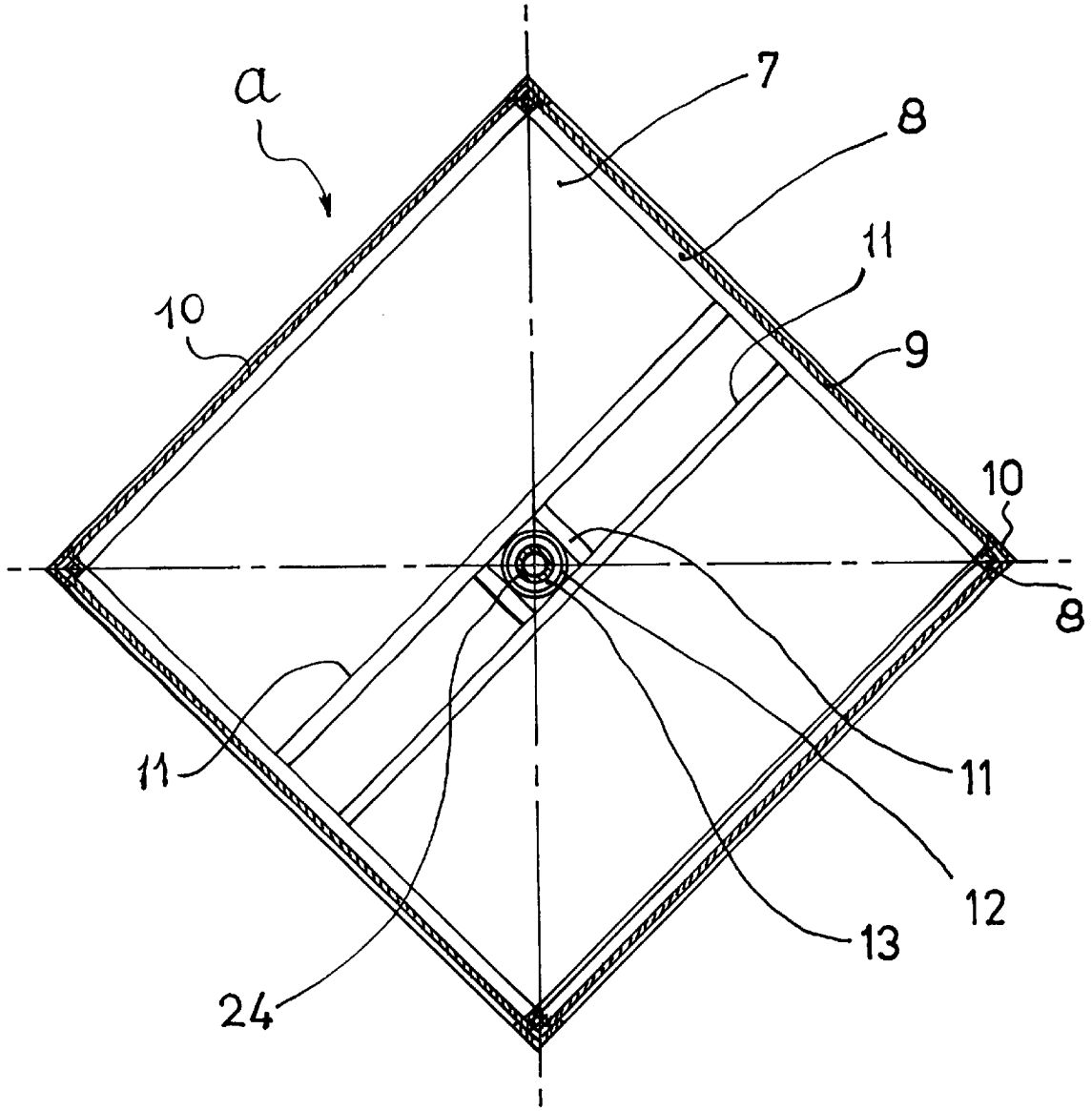
FIG. 3 is a cross section of the main body that appears indicated as A—A in FIG. 2. The feature of the superior frame of the structure with the superior bearing in the central part can be seen.
Figure 4:
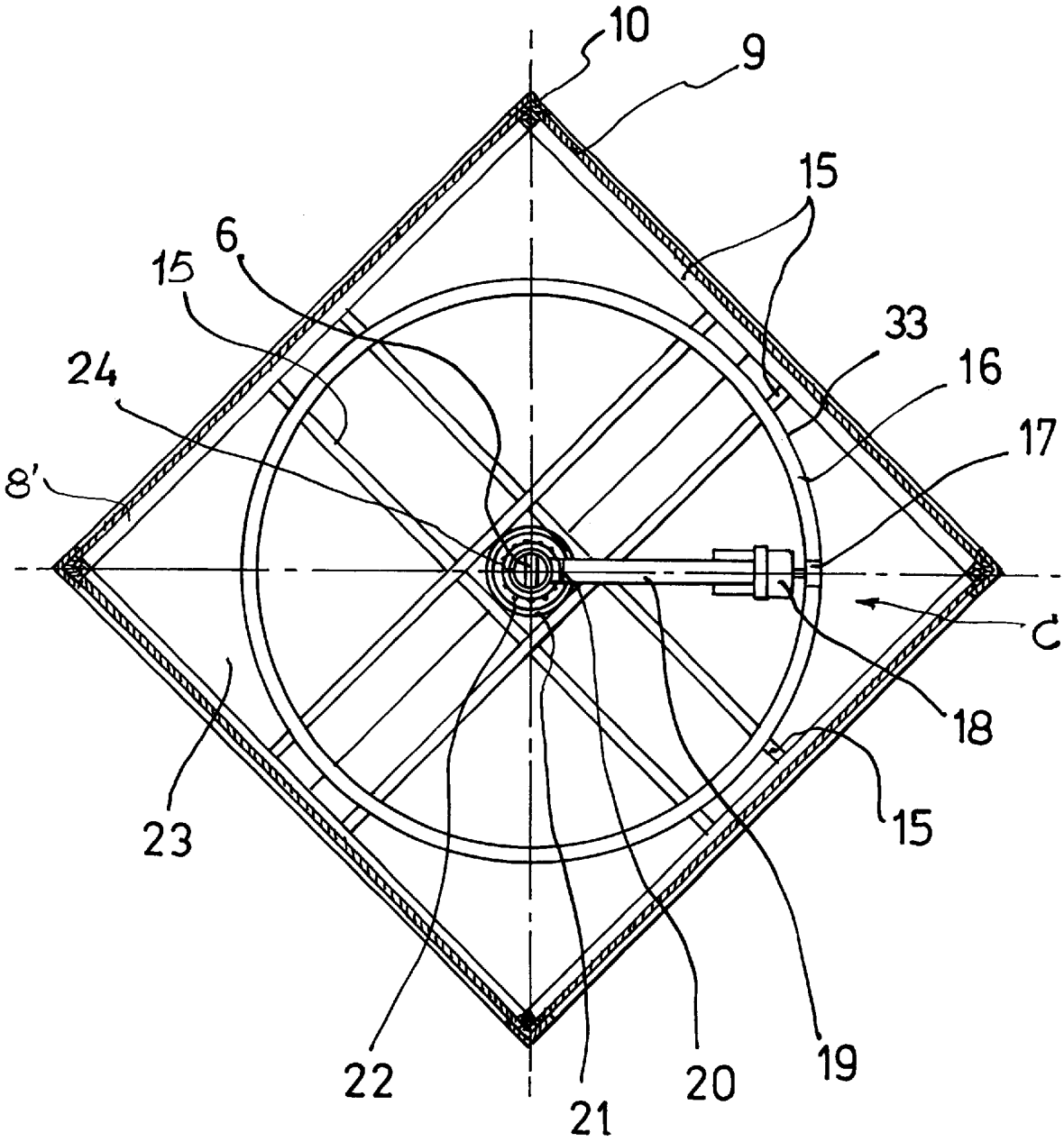

FIG. 4 is a cross section of the main body appearing indicated as B—B in FIG. 2. The feature of the inferior frame of the structure with the inferior bearing in the central part can be seen. The rotary driving means are also seen: radial arm, motor-reducer, friction wheel and ring-shaped piece with support track.

Figure 5:
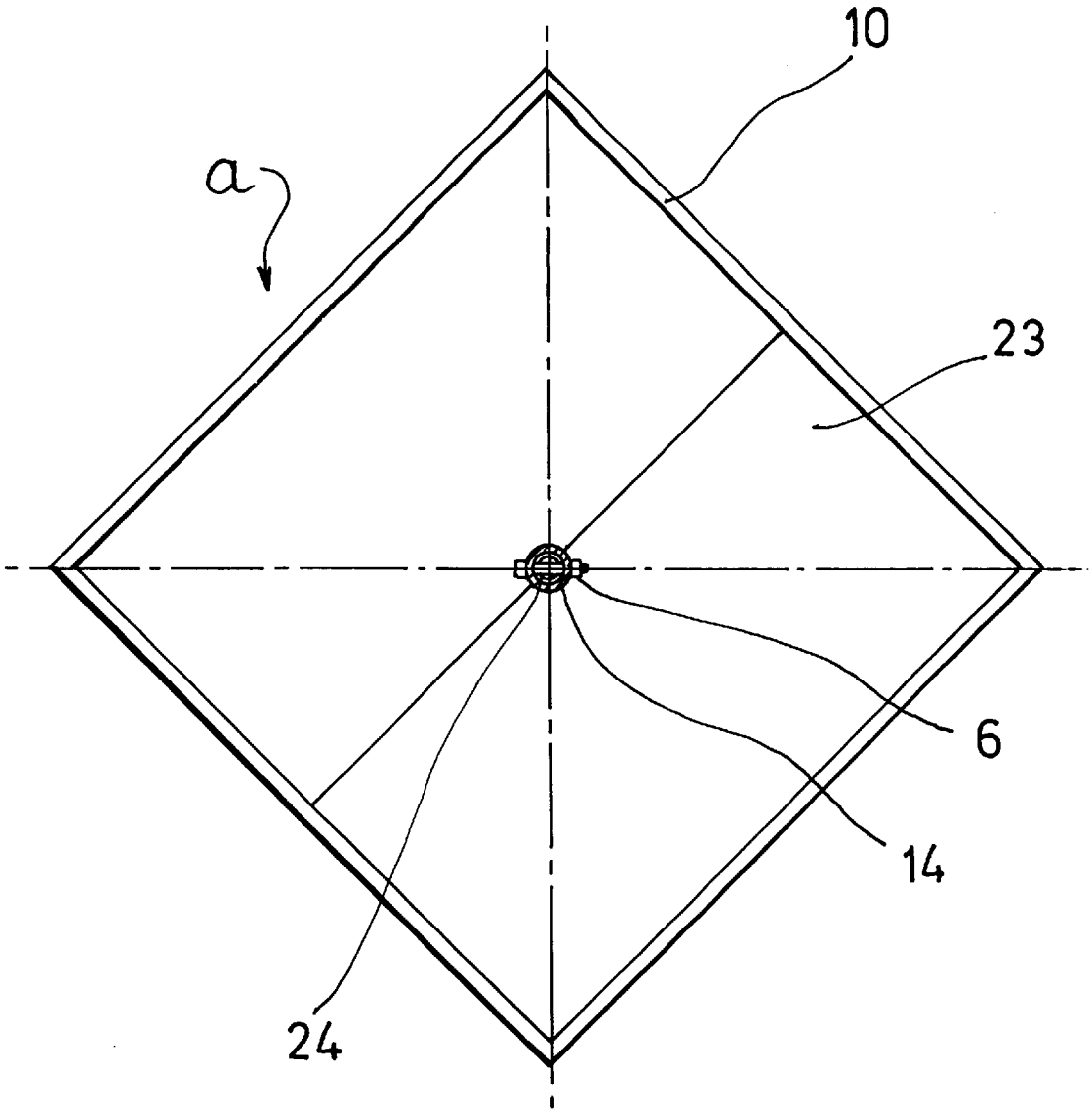

FIG. 5 is a cross section of the main body appearing indicated as C—C in FIG. 2 and it allows to appreciate the connection between the main body and the superior tract of the support.

Figure 6:
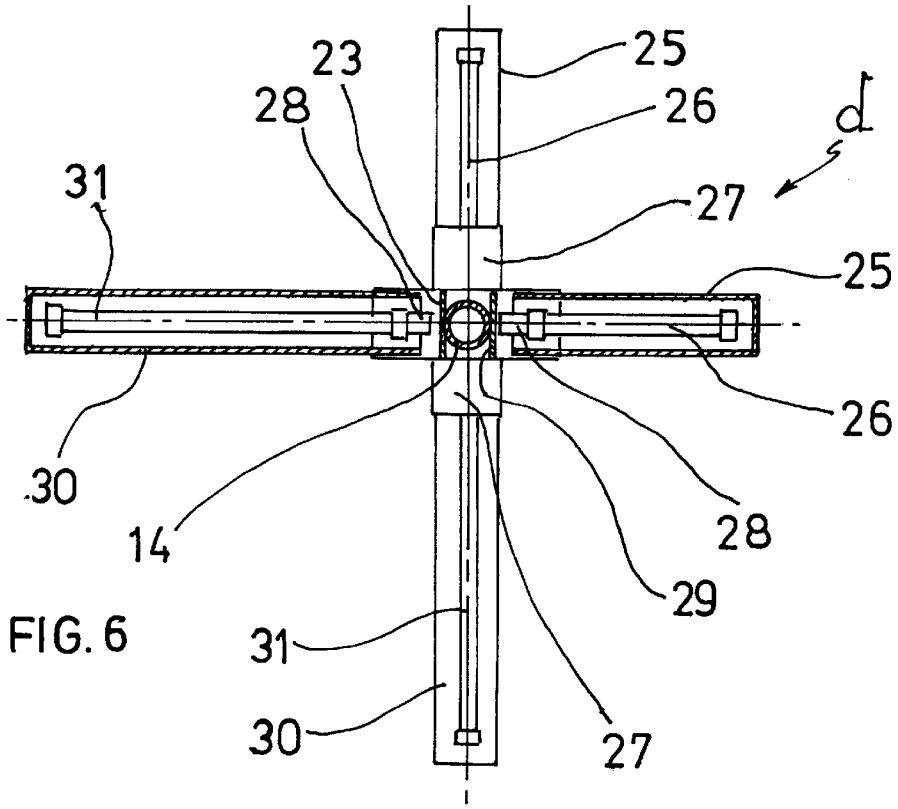

FIG. 6 is a cross section of the supplementary poster that appears indicated as D—D in FIG. 2.

Figure 7:
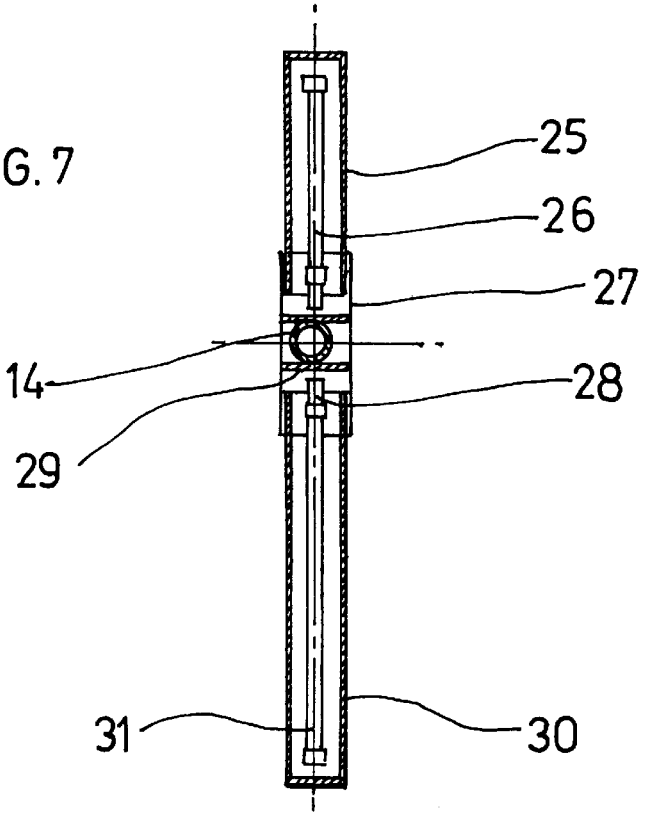

FIG. 7 is a cross section of the supplementary poster that appears indicated as E—E in FIG. 2.

Figure 8:
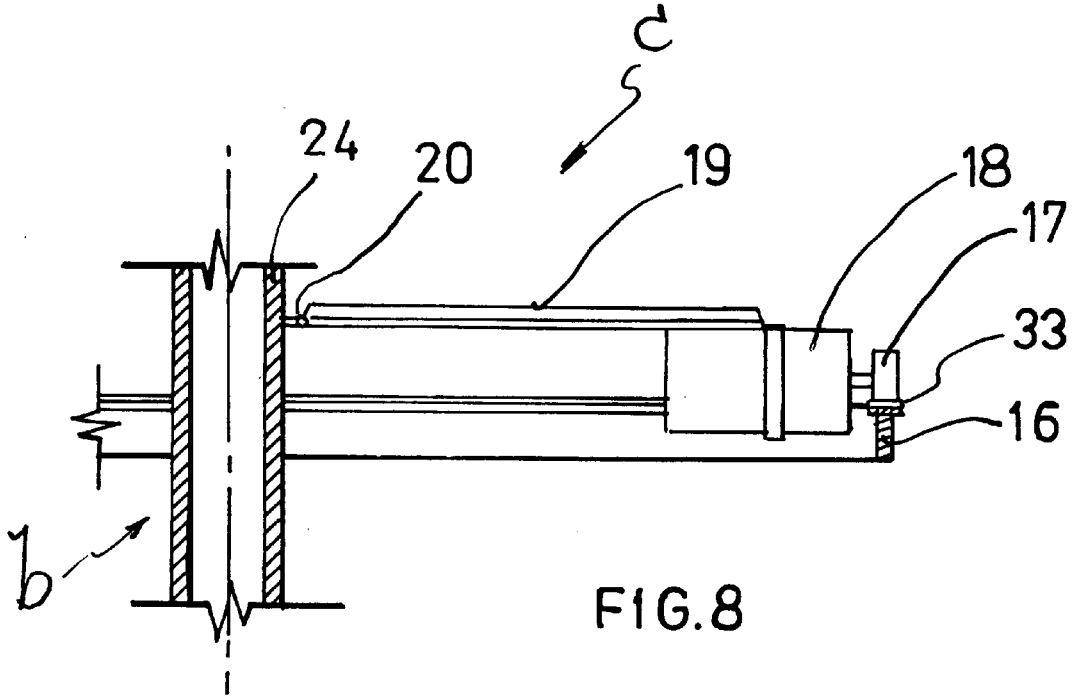

FIG. 8 is a lateral view of the radial arm with its provided motor-reducer of the friction wheel.

Figure 9:
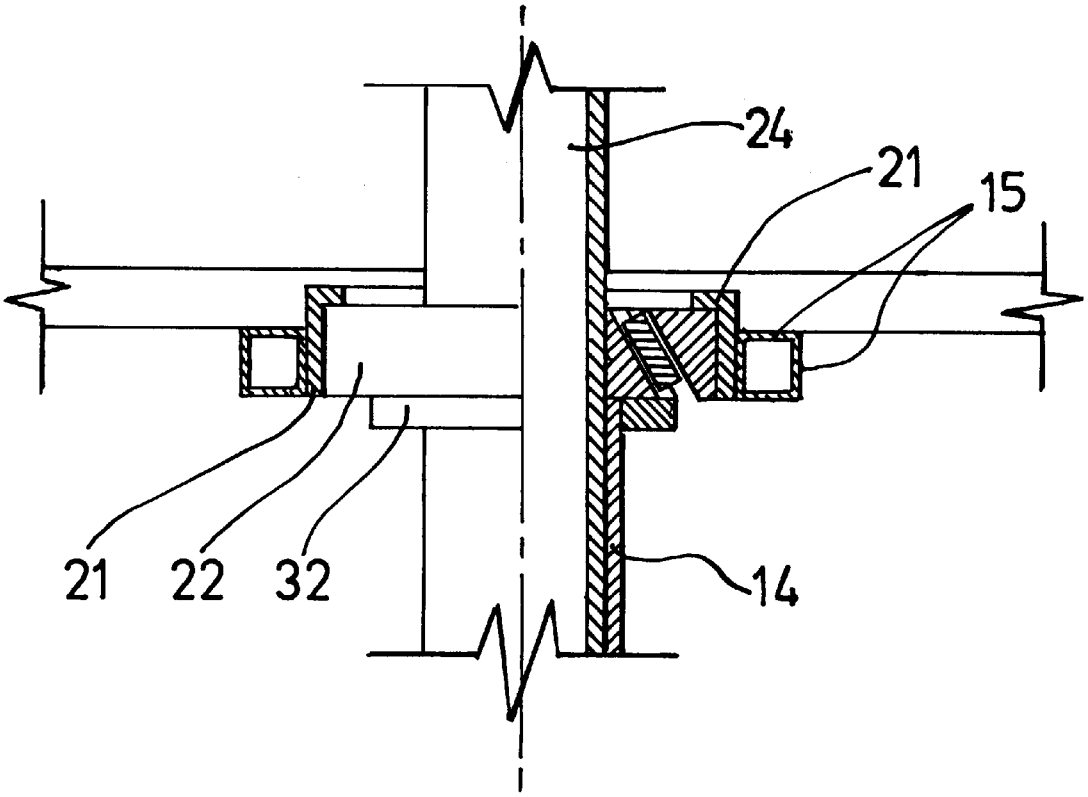

FIG. 9 is a longitudinal section of the inferior part of the main body in which a detail of the connection between said main body and the support can be seen, being able to observe the seat of the inferior bearing.

In the different figures, the same reference numbers indicate same or corresponding parts, and the groups of several elements have been pointed out with letters.

Listing of the main references:

(a) main body.

(b) support of the main body (a).

(c) rotary driving means.

(d) supplementary fixed posters.

(1) advertising faces of the main body (a).

(2) superior supplementary poster.

(3) inferior supplementary poster.

(4) tubular body of the support (b).

(5) inferior part of the tubular body (4).

(6) connection means among the main body (a) and the support (b).

(7) superior closing wall.

(8) superior supporting borders [for the superior wall (7)].

(8') inferior supporting borders [for the inferior wall (23)].

(9) translucent lateral walls that provide the faces (1).

(10) structure of the main body (a).

(11) superior frame of the structure (8).

(11') crosspieces of the superior frame (11).

(12) first wedging hoop.

(13) superior bearing.
(14) superior track of the tubular body (4).
(15) inferior frame of the structure (8).
(16) ring-shaped piece that provides the support track (33).
(17) friction wheel.
(18) motor-reducer.
(19) radial arm.
(20) articulation of the radial arm (19).
(21) second wedging hoop.
(22) inferior bearing.
(23) inferior closing wall.
(24) center of rotation of the main body (a).
(25) translucent minor bodies of the supplementary posters (2)(3).
(26) minor lamps.
(27) fixed bases of the supplementary posters (2)(3).
(28) lamp holder.
(29) fixation walls of the fixed bases (27).
(30) translucent major bodies of the supplementary posters (2) (3).
(31) mayor lamps.
(32) top seating of the inferior bearing (22).
(33) rough support track of the ring-shaped piece (16).

III MAIN OBJECT

To the specified ends, the rotary driven poster, that can be used with advertising, informative ends and other uses is of the type that includes at least a main body (a) which, presenting faces (1) that contain the advertising or informative composition of visual reception, on one hand is mounted to a support (b), while on the other, said body (a) is connected to a device that drives it with uniform circular movement, said poster is characterized because it includes:

a) a rotation center (24) of the main body (a) that, connected to the support (b) of said body (a), it possesses a radial arm (19) on which a motor-reducer (18) is mounted whose axis supports a wheel (17), structured in material of friction; and b) a ring-shaped piece (16), fixed to the structure (10) of the main body (a) itself in concentric disposition with the rotation axis whose radius is equivalent to that of the mentioned radial arm (19), said ring-shaped piece (16), constituting the support track (33) of the friction wheel (17); being the same friction wheel (17), the rotary driving means of the main body (a) through the support track (33).

IV DESCRIPTION OF THE PREFERRED EMBODIMENTS

In general terms, the present invention is a rotary driven poster, to be used for advertising, informative ends and other uses, that mounted on a support (b) and provided with faces for advertising exhibition (1), includes a main body (a) having rotary driving means (c) consisting in a radial arm (19) with a motor-reducer (18), its friction wheel (17) leaning on the track (33) of a ring-shaped piece (16) of said main body (a).

More particularly, the present rotary poster is mounted on a support (b) of tubular body (4) that, while by its inferior end (5) it is connectable to any base of appropriate fixation, on the opposite part it ends in a superior track (14) finished off in an end of seat (32).

In the end of this superior track (14) the main body (a) of the poster is disposed, fixed with a means of connection (6) constituted by a bolt with the respective nut.

On the other hand, the main body (a) of the poster it includes a structure (10) rotatively mounted on a rotation center (24) constituted by a tubular body. In the present way of embodiment, this structure (10) presents a cubic prismatic conformation, although different embodiments have been foreseen in which the structure (10) confers to the main body (a) different conformations, being able to by frustum-conical, frustum-pyramidal truck, pyramidal, conical, trunk-conical, trunk-pyramidal, spherical prismatic, etc. Anyway, it is a main body (a) capable to house in its interior one or more luminous sources.

The mentioned structure (10) of the main body (a) serves as mounting to translucent lateral walls (9) that, outwardly, define the advertising faces (1) of the poster. In the superior part of the main body (a), there are superior borders (8) that serve as mounting to a superior closing wall (7). Below this superior wall (7), the structure (10) conforms a superior frame (11) composed by two longitudinal beams and two crosspiece (11') having in its central part a first wedging hoop (12). Inside this hoop (12) there is a superior bearing (13) that mounts on the superior end of the rotation center (24).

In the inferior part of the main body (a), there are some inferior borders (8') for the mounting of the inferior closing wall (23). Inside the main body (a), above this inferior wall (23), the structure (10) conforms an inferior frame (15) composes by two sets of intertwined longitudinal beams. In the central part of this frame (15), there is a second wedging hoop (21) for an inferior bearing (22) that mounts on the inferior part of the rotation center (24).

On the other hand, the poster has rotary driving means (c) consistent in a ring-shaped piece (16) of support and a friction wheel (17) moved by a motor-reducer (18). The ring-shaped piece (16) is mounted on the inferior frame (15), in a concentric disposition with the rotation center (24) with operates as the rotation axis. The rough superior border or surface of this ring-shaped piece (16) conforms a support track (33) destined to said friction wheel (17). The latter (17) is supported by the axis of the motor-reducer (18) that is mounted on a radial arm (19).

This radial arm (19), on the other hand, is fixed to the rotation center (24) of the main body (a) also disposing of an articulation (20) that confers it capacity of angular movement within a non operational position of approach to the mentioned rotation center (24) and an operative position of support on the ring-shaped piece (16). In this last position the friction wheel (17) supports on the support track (33) of this ring-shaped piece (16) due to the effect on the weight of the radial arm (19) and of the motor-reducer (18) themselves.

Within the same principle, other embodiments have been foreseen in which the poster includes several main bodies (a) each one of which possess a respective ring-shaped piece (16) on each support track (33) having disposed a respective radial arm (19) with its motor-reducer (18) and its friction wheel (17). Further, using the same support (b) and at different height, there are mounted diverse radial arms that end in respective motor-reducers with friction wheels in their axes, and these friction wheels correspond to respective ring tracks of respective rotary main bodies.

Variants have also been foreseen in which the main body (a) has a interior luminous source. With regard to the advertising faces (1), besides the described variations, there is another form in which said faces (1) are conformed by transparent external walls (9) fixed to the support (b), while, behind, there are internal walls that contain the advertising composition and that they are mounted in a structure (10) linked to the ring-shaped piece (16).

Finally, the rotation center (24) of the main body (a) ends in an inferior end that wedges in the superior track (14) of the tubular body (4) of the support (b), place where said main body (a) is fixed by the means of connection (6) that crosses the walls of said center (24) and said superior track (14). The set works in the following way:

When put into operation the motor-reducer (18), the friction wheel (17) that leans on the rough support track (33) of the ring-shaped piece (16), drive the rotary movement of the main body (a) of the poster. This is because the mentioned ring-shaped piece (16) is fixed to the structure (10) of the main body (a) by means of the inferior frame (15).

Together with this, the rotary movement of the mentioned main body (a) is possible due to the linking between the same and the rotation center (24). This linking, in the superior part, consists on the superior bearing (13) that links rotatively to the superior frame (11) with said rotation center (24), allowing the structure (10) to rotate around said center (24).

In the inferior part of the main body (a), the mentioned linking is given by the inferior bearing (22) that, while on one hand links rotatively the inferior frame (15) with the rotation center (24), on the other hand it supports against the end of seat (32) provided by the superior tract (14) of the support (b).

In these conditions, any obstacle or detention in the revolving movement of the main body (a), does not cause damages in the mechanism of rotary drive (c), since the friction wheel (17) continues rotating, even though the ring-shaped piece (16) offers resistance or stop. Also, in these cases, the articulation (20) allows to lift the radial arm (19) to avoid the wearing out of the friction wheel (17).

On the other hand, the support (b) of the main body (a) can be constituted by a tube (4), by a column or by post that may be anchored to a fastening structure. Anyway, to the effects of supplementing the advertising information exhibited in faces (1) of the main body (a), on the support (b) fixed supplementary posters (2)(3) provided of respective fixed bases (27) can be prepared.

Each one of these bases (27), on one hand, have a fixation or bottom wall (29) fixed to the superior tract (14) of the support (b), while on the opposed part it serves as mounting to translucent bodies (25) (30). As each supplementary fixed poster (2) (3) has two bases (27) guided in opposed direction, on a base (27) a major translucent body (30) is mounted having a lamp holder (28) and a major lamp (31); and in the opposite base (27) a minor translucent body goes (25) with its respective lamp holder (28) and minor lamp (26).

It cannot be doubted that when the present invention is put into practice, modification concerning certain details in construction and shape, may be introduced without this implying drawing apart from the fundamental principles that are clearly substantiated in the clauses of the following claims:

What is claimed is:

1. A ROTARY DRIVEN POSTER, TO BE USED WITH ADVERTISING and INFORMATIVE ENDS including: at least a main body (a) which, presenting faces (1) that contain an advertising or informative composition of visual reception, on one hand is mounted to a support (b), while on the other, said body (a) is connected to a device that drives it with uniform circular movement, said poster as characterized includes:

(a) a rotation center (24) of the main body (a) is connected to the support (b) of said body (a), it possesses a radial arm (19) on which a motor-reducer (18) is mounted whose axis supports a wheel (17), structured in material of friction to form a friction wheel;

(b) a ring-shaped piece (16), fixed to a structure (10) of the main body (a), said ring-shaped piece is in concentric disposition with the rotation axis whose radius is equivalent to that of the mentioned radial arm (19), said ring-shaped piece (16), constituting a support track (33) for the friction wheel (17); and the same friction wheel (17) being a rotary driving means of the main body (1) through the support track (33); and (c) said radial arm confers its capacity of angular movement with a non-operational position of approach to said rotation center and an operative position of support on said ring-shaped piece.

2. The ROTARY DRIVEN POSTER, TO BE USED WITH ADVERTISING and INFORMATIVE ENDS, in accordance with claim 1, wherein the ring-shaped piece, in contact with the friction wheel, has a rough surface.

3. The ROTARY DRIVEN POSTER, TO BE USED WITH ADVERTISING and INFORMATIVE ENDS, in accordance with claim 1, wherein the support of the main body is a tube to which the radial arm is fixed.

4. The ROTARY DRIVEN POSTER, TO BE USED WITH ADVERTISING and INFORMATIVE ENDS, in accordance with claim 1, wherein the support of the main body is a column.

5. The ROTARY DRIVEN POSTER, TO BE USED WITH ADVERTISING and INFORMATIVE ENDS, in accordance with claim 1, wherein the support of the main body is a post that can be anchored to a fastening structure.

6. The ROTARY DRIVEN POSTER, TO BE USED WITH ADVERTISING and INFORMATIVE ENDS, in accordance with claim 1, wherein the radial arm is articulated.

7. The ROTARY DRIVEN POSTER, TO BE USED WITH ADVERTISING and INFORMATIVE ENDS, in accordance with claim 6, wherein the friction wheel leans on the support track of the ring-shaped piece by the effect of the weight of the articulate radial arm carried by the motor-reducer.

8. The ROTARY DRIVEN POSTER, TO BE USED WITH ADVERTISING and INFORMATIVE ENDS, in accordance with claim 1, wherein the main body possesses in its structure a frame to which the support track and the ring-shaped piece are fixed.

9. The ROTARY DRIVEN POSTER, TO BE USED WITH ADVERTISING and INFORMATIVE ENDS, in accordance with claim 1, wherein the main body is of prismatic format.

10. The ROTARY DRIVEN POSTER, TO BE USED WITH ADVERTISING and INFORMATIVE ENDS, in accordance with claim 1, wherein the main body also possesses, an interior luminous source.

11. The ROTARY DRIVEN POSTER, TO BE USED WITH ADVERTISING INFORMATIVE ENDS, in accordance with claim 1, wherein the friction wheel is structured in rubber.

12. The ROTARY DRIVEN POSTER, TO BE USED WITH ADVERTISING and INFORMATIVE ENDS, in accordance with claim 1, wherein the main body has external walls that are fixed to the support, said external walls having internal walls that contain an advertising/informative composition, and are connected to the ring-shaped piece, said external walls being of transparent structure.

13. The ROTARY DRIVEN POSTER, TO BE USED WITH ADVERTISING and INFORMATIVE ENDS, in accordance with claim 12, wherein the external walls of the main body are translucent.

* * * * *